United States Patent [19]

Stanton et al.

[11] 4,445,948

[45] May 1, 1984

[54] POLYMER MODIFIED TNT CONTAINING EXPLOSIVES

[75] Inventors: Horace D. Stanton; Russell Reed, Jr., both of Ridgecrest, Calif.

[73] Assignee: The United States of America as represented by the Secretary of the Navy, Washington, D.C.

[21] Appl. No.: 415,495

[22] Filed: Sep. 7, 1982

Related U.S. Application Data

[63] Continuation-in-part of Ser. No. 155,877, Jun. 2, 1980, abandoned.

[51] Int. Cl.[3] ..... C06B 45/10

[52] U.S. Cl. ..... 149/19.91; 149/18; 149/19.92; 149/20; 149/92; 149/105; 149/109.6

[58] Field of Search ..... 149/18, 19.91, 19.92, 149/20, 92, 105, 109.6

[56] References Cited

U.S. PATENT DOCUMENTS

| | | | |
|---|---|---|---|
| 2,304,037 | 12/1942 | Thomson et al. | 52/7 |
| 2,349,048 | 5/1944 | Mackey | 52/5 |
| 2,858,289 | 10/1958 | Bohn et al. | 260/30.6 |
| 3,116,186 | 12/1963 | Paul | 149/19.91 |
| 3,428,502 | 2/1969 | Evans et al. | 149/92 |
| 3,472,713 | 10/1969 | Berthmann et al. | 149/105 |
| 3,679,781 | 7/1972 | Olson et al. | 264/3 R |
| 3,745,076 | 7/1973 | Sickman et al. | 149/195 |
| 3,884,735 | 5/1975 | Cramer | 149/105 |
| 4,012,245 | 3/1977 | Voigt et al. | 149/105 |
| 4,090,894 | 5/1978 | Reed et al. | 149/19.91 |
| 4,100,000 | 7/1978 | Sterling et al. | 149/105 |
| 4,113,811 | 9/1978 | Helfgen et al. | 149/19.91 |
| 4,284,422 | 8/1981 | Voigt | 149/105 |

*Primary Examiner*—Edward A. Miller

*Attorney, Agent, or Firm*—Robert F. Beers; W. Thom Skeer; Bruce H. Cottrell

[57] ABSTRACT

The present invention relates to an improved explosive TNT based composition consisting of TNT, HDX, RDX, aluminum and a small amount of an elastomeric linear polymer having polar groups dissolved or dispersed throughout, said composition having improved properties. Such improved properties include: reduced cracking and exudation, improved friction sensitivity, sympathetic detonation and enhanced cook-off hazard properties.

10 Claims, No Drawings

POLYMER MODIFIED TNT CONTAINING EXPLOSIVES

This application is a continuation-in-part of application Ser. No. 155,877 filed June 2, 1980, and now abandoned.

BACKGROUND OF THE INVENTION

1. Field of the Invention

This invention relates to TNT based explosives. More particularly it relates to coated TNT based explosives to prevent so-called cook-off (explosion) when said explosives are exposed to heat or become heated. Still more particularly it relates to a group of coating materials for TNT based explosives that prevent cook-off when said explosives are exposed to thermal conditions.

2. Description of the Prior Art

Trinitrotoluene (TNT) alone and as modified with other explosive compositions are available at relatively low cost and are conveniently processed to yield castable explosives. This composition suffers, however, from several disadvantages. TNT containing explosives tend to exude and crack upon temperature cycling, decompose autocatalytically upon being exposed to fuel fires and explode or detonate when in a bomb or warhead configuration, and, further tend to detonate if struck by a bullet or high velocity fragments. These drawbacks have been partially ameliorated in the past by using wax type coatings as desensitizers and process aids. Such wax coatings are deposited irregularly as agglomerates onto the explosive composition. As such, wax coatings tend to run off the explosive composition surface upon exposure to heat and create potential cook-off conditions. Further, the wax obtainable varies in quality thus creating a non-uniform surface.

BRIEF SUMMARY OF THE INVENTION

This invention overcomes the disadvantages of previous wax coatings by providing a metl cast, explosive, TNT based composition consisting of INT, RDX, HMX, aluminum and an elastomeric linear polymer having polar groups dissolved or intimately dispersed throughout said composition. Such an elastomeric linear polymer having polar groups provide solubility or dispersibility of said polymer throughout the composition and also enhances the affinity of the additive for polar surfaces available by other explosive ingredients within the composition, such as, aluminum, cyclic nitramines (RDX, HDX), and oxidizers (ammonium nitrate). The RDX and HMX ingredients are the most hazardous of the ingredients and therefore are coated to achieve explosives having reduced hazard sensitivities such as cook-off, sympathetic detonation and fragment initiation. These additives also substantially reduce cracking and exudation.

OBJECTS OF THE INVENTION

An object of the present invention is to provide an improved explosive TNT based composition having an elastomeric linear polymer having polar groups dissolved or dispersed throughout said composition that enhances cook-off hazard properties upon temperature cycling, as well as, improving friction sensitivity, and enhancing sympathetic detonation.

Another object of the present invention is to provide a method for making an improved explosive TNT based composition having an elastomeric linear polymer having polar groups dissolved or dispersed throughout said composition that enhances cook-off hazard properties and reducing cracking and exudation upon temperature cycling, as well as, improving friction sensitivity, and enhancing sympathetic detonation.

Other objects and many advantages of this invention will be readily appreciated as the same becomes better understood by reference to the following detailed description.

DESCRIPTION OF THE PREFERRED EMBODIMENT

A new explosive TNT based composition consisting of TNT, RDX (cyclotrimethylenetrinitramine), HMX (cyclotetramethylenetetranitramine), and aluminum with an elastomeric linear polymer having polar groups dissolved or dispersed throughout said composition and its use are disclosed by applicants. The elastomeric linear polymer having polar groups allows affinity of the various additives to the TNT based composition thus yielding an end product with reduced exudation upon temperature cycling, improved friction sensitivity and enhancement of cook-off hazard properties. The preferred elastomeric linear polymers having polar groups are ethylene vinyl acetate copolymer, a latex terpolymer of polyethylene, polyvinyl acetate, polyvinyl alcohol and low molecular weight linear hydroxy acrylates and methacrylates.

The inventive TNT based composition is a melt cast explosive wherein particles of HMX or RDX, previously coated with the elastomeric linear polymer of the invention, is mixed into the melted TNT along with particles of aluminum. A portion of the elastomeric linear polymer then tends to dissolve or disperse throughout the melt. The melt is then cast and cooled to form the inventive explosive composition.

The following examples are presented only to illustrate the invention.

EXAMPLE 1

30 parts by weight of 2,4,6-trinitrotoluene (solidification point 80.2° C.) were heated with agitation to 90°-110° C. While maintaining the molten TNT at 90°-100° C. the following were added with agitation:

20 parts aluminum powder of about 40 mesh size, and 50 parts ethylene vinyl acetate copolymer coated RDX. The ethylene vinyl acetate copolymer containing 70% ethylene moieties and 30% vinyl acetate moieties used as the coating for the RDX made up 10 percent by weight of the coated RDX particles, amounting to 5 parts of the total TNT mix. RDX type II, Class 1 with a mean particle diameter of about 120 microns was used.

The resulting mixture was poured into containers and allowed to solidify. A typical explosive, H-6, a control composition was similarly prepared having 30 parts TNT, 45 parts RDX, 5 parts D-2 wax composition, and 20 parts aluminum powder. The impact sensitivity test (50% point, 2.5 Kg weight), an important measure of processing hazards, utilizing 35 milligram samples of the H-6 control composition and the inventive composition resulted in a 33 cm sensitivity for H-6 control as compared to 49 cm sensitivity for the inventive composition. This illustrates an improvement of 16 cm impact sensitivity or about 46% improvement.

EXAMPLE 2

An explosive composition according to the invention was prepared according to the method and formula of Example 1 except the RDX was coated with a terpolymer containing 10% polyethylene, 85% polyvinyl acetate, and 5% polyvinyl alcohol. The resulting composition demonstrated an impact sensitivity of 37 cm as compared with 33 cm for the H-6 control composition or about a 12% improvement.

Other polymers useful for preparing modified H-6 according to the invention include polyhydroxyethyl acrylate, polypropylene glycol monoacrylate, polyethylene glycol, and copolymers of polyethylene and polypropylene oxide.

Coating of the RDX or HMX particles with the desired polymer is accomplished by dissolving the desired amount of polymer in a solvent such as benzene or tetrahydrofuran and adding the solution with stirring to an RDX/water or HMX/water slurry, which is stirred until mixing is complete, then filtered and dried yielding polymer coated explosive particles. The preferred mean particle diameter of the RDX or HMX particles for use in the present invention is about 120 microns. The terpolymer of polyethylene, polyvinyl acetate, and polyvinyl alcohol in Example 2 was added to the solvent in latex form.

An alternative method of preparing an explosive composition according to the invention is to add a polymer such as the terpolymer of Example 2 in latex form to melted TNT. Then add aluminum powder and RDX or HMX while mixing and remove the water under vacuum. The composition is then cast and allowed to solidify the explosive product.

When explosive compositions containing ethylene vinyl acetate coated RDX were subjected to tests such as repeated temperature cycles they were found to have substantially less cracking and exudation than a corresponding composition containing conventional wax.

In summary, hazard sensitivity as measured by impact sensitivity was improved through practice of the invention. Also, reduced cracking and exudation of the explosive grain when exposed to repeated temperature cycling has been demonstrated. Moreover, availability of necessary ingredients to prepare applicants' invention are assured.

We claim:

1. A melt cast explosive composition consisting essentially of trinitrotoluene, a cyclic nitramine explosive selected from the group consisting of cyclotrimethylenetrinitramine and cyclotetramethylenetetranitramine, aluminum powder, and a polymer selected from the group consisting of ethylene vinyl acetate copolymer and an ethylene, vinyl acetate, vinyl alcohol terpolymer.

2. A composition as in claim 1 wherein said composition consists essentially of by weight about 30 percent trinitrotoluene, about 45 percent cyclic nitramine explosive, about 5 percent polymer, and about 20 percent aluminum powder.

3. A composition as in claim 1 wherein said polymer is ethylene vinyl acetate copolymer made from about 70 percent ethylene and about 30 percent vinyl acetate.

4. A composition as in claim 1 wherein said polymer is an ethylene, vinyl acetate, vinyl alcohol terpolymer, made from about 10 percent ethylene, about 85 percent vinyl acetate, and about 5 percent vinyl alcohol.

5. A method of making a melt cast explosive composition comprising:

(a) to molten trinitrotoluene during agitation adding aluminum powder and particles of a cyclic nitramine explosives selected from the group consisting of cyclotrimethylenetrinitramine and cyclotetramethylenetetranitramine, said cyclic nitramine explosive particles having a coating of a polymer selected from the group consisting of ethylene vinyl acetate copolymer and an ethylene, vinyl acetate, vinyl alcohol terpolymer; and (b) casting the resulting composition of step (a) and allowing it to solidify to form the explosive product.

6. The method of claim 5 wherein said cyclic nitramine explosive particles are coated with said polymer according to the following steps:

(a) dissolving said polymer in a solvent to form a solution;

(b) adding said solution with stirring to a slurry of said cyclic nitramine particles in water; and (c) separating and drying polymer coated explosive particles.

7. The melt cast explosive composition of claim 1 wherein said composition is produced by:

adding aluminum powder and particles of a cyclic nitramine explosive selected from the group consisting of cyclotrimethylenetrinitramine and cyclotetramethylenetetranitramine to molten trinitrotoluene during agitation, said cyclic nitramine explosive particles having a coating of a polymer selected from the group consisting of ethylene vinyl acetate copolymer and an ethylene, vinyl acetate, vinyl alcohol terpolymer; and casting the resulting composition and allowing it to solidify to form the explosive composition.

8. A method of making a melt cast explosive composition comprising:

(a) to molten trinitrotoluene during agitation adding a polymer in latex form selected from the group consisting of ethylene vinyl acetate copolymer and an ethylene, vinyl acetate, vinyl alcohol terpolymer;

(b) to the resulting mixture of step (a) while mixing, adding aluminum powder and a cyclic nitramine explosive selected from the group consisting of cyclotrimethylenetrinitramine and cyclotetramethylenetetranitramine; and (c) subjecting the resulting mixture of step (b) to vacuum to remove water therefrom and casting the resulting composition allowing it to solidify to form the explosive product.

9. The melt cast explosive composition of claim 1 wherein said composition is produced by:

adding a polymer in latex form selected from the group consisting of ethylene vinyl acetate copolymer and and ethylene, vinyl acetate, vinyl alcohol terpolymer to molten trinitrotoluene during agitation to form a first resulting mixture;

adding aluminum powder and a cyclic nitramine explosive selected from the group consisting of cyclotrimethylenetrinitramine and cyclotetramethylenetetranitramine to the first resulting mixture while mixing to form a second resulting mixture; and subjecting the second resulting mixture to vacuum to remove water therefrom, casting the resulting composition and allowing it to solidify to form the explosive composition.

10. The melt cast explosive composition according to claim 7 wherein said cyclic nitramine explosive particles are coated with said polymer according to the following steps:

dissolving said polymer in a solvent to form a solution;

adding said solution with stirring to a slurry of said cyclic nitramine particles in water; and separating and drying polymer coated explosive particles.

* * * * *